United States Patent [19]

Krauchick

[11] Patent Number: 4,512,215

[45] Date of Patent: Apr. 23, 1985

[54] RADIATOR CAP REMOVING DEVICE

[76] Inventor: Walter Krauchick, 28 Humphrey St., Seymour, Conn. 06483

[21] Appl. No.: 490,340

[22] Filed: May 2, 1983

[51] Int. Cl.[3] ..... B67B 7/00

[52] U.S. Cl. ..... 81/3.44; 81/176.1

[58] Field of Search ..... 81/3.44, 90 D, 121 A

[56] References Cited

U.S. PATENT DOCUMENTS

| | | | |
|---|---|---|---|
| 2,499,032 | 2/1950 | Niblett | 81/3.44 X |
| 2,655,824 | 10/1953 | Land et al. | 81/3.44 X |
| 2,956,461 | 10/1960 | Anderson | 81/90 D X |
| 3,014,389 | 12/1961 | O'Hara | 81/90 D |
| 3,086,414 | 4/1963 | Nardi | 81/90 D |

*Primary Examiner*—James G. Smith

*Attorney, Agent, or Firm*—Lawrence Hager

[57] ABSTRACT

A radiator cap removing device formed of suitable material having a proper thickness, such as metal or from various heat resistive type thermoduric plastics and resins. The cap removing device has a cylindrical elongate body member with a top wall and being open at its bottom end for defining a radiator cap receiving chamber. A lever bar or arm is affixed to the top wall to facilitate rotation of the radiator cap. Two diametrically disposed slots are provided within the body member each dimensioned for receiving and abutting a respective protuberant portion of the radiator cap. An adjustable lief spring like cap clamping/engaging member may be provided within the chamber to facilitate removal of different sized radiator caps and those without protuberant portions.

11 Claims, 9 Drawing Figures

FIG. 4
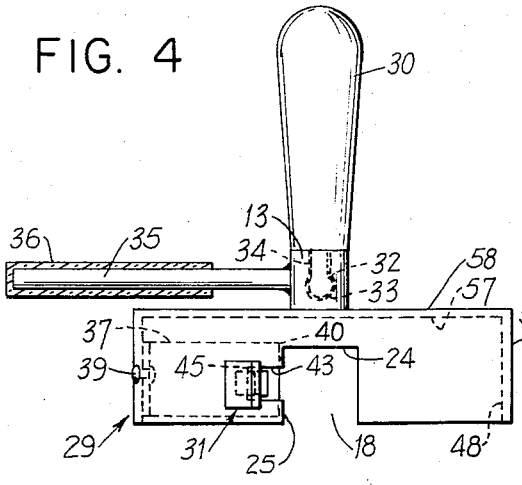
FIG. 7
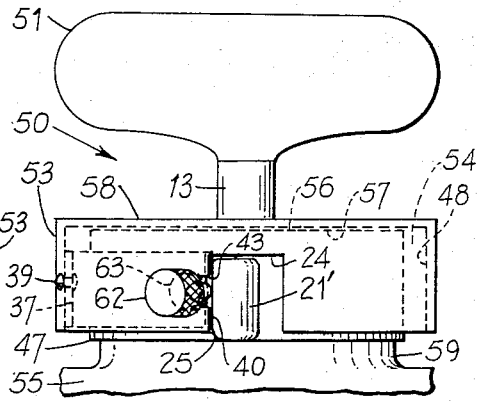
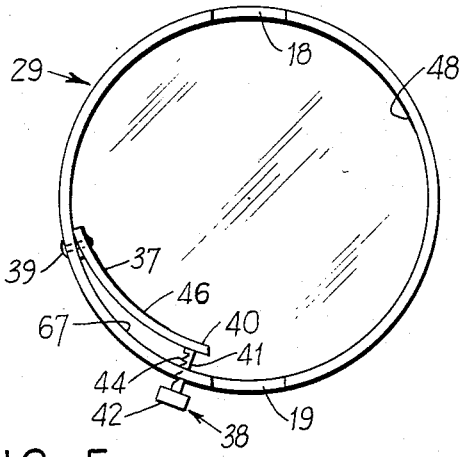
FIG. 5
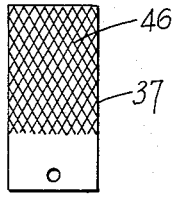
FIG. 6
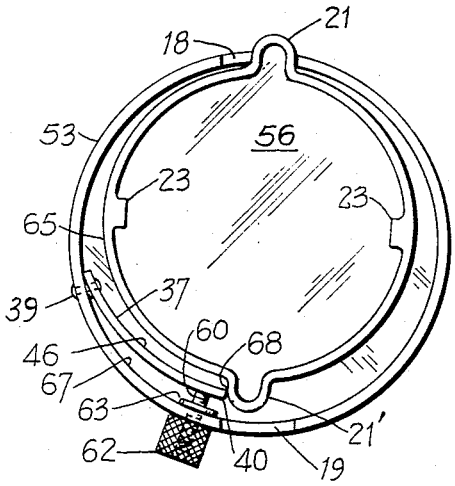
FIG. 8
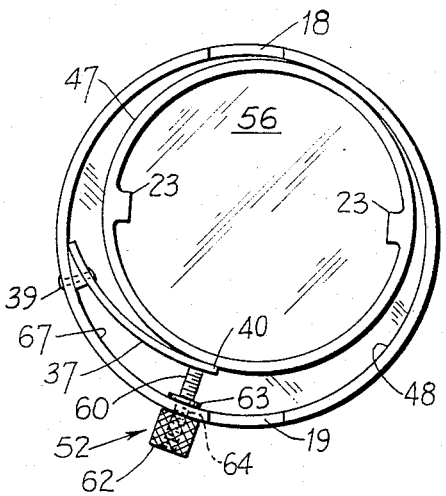
FIG. 9

RADIATOR CAP REMOVING DEVICE

FIELD OF THE INVENTION

This invention relates to (automotive) tools and particularly to a device that can be utilized as an aid in removing a radiator cap from a radiator.

BACKGROUND OF THE INVENTION

Caps have been used for many years, for example, on automobile radiators to enable the operator to replenish the radiator fluid. Generally speaking, the radiator caps comprise a screw or twist on/off type cover to provide a substantially watertight closure of the radiator and for retaining under pressure the fluid within the radiator. Oftentimes, however, the fluid within the radiator becomes superheated which hitherto has presented a serious risk of burn injury to those attempting to remove the radiator cap.

SUMMARY OF THE INVENTION

Generally speaking, in accordance with the invention, a tool or device (10 or 29 or 50) is provided having particular utility for facilitating substantially safe and easy removal of a cap, for example, a radiator cap (17 or 47 or 65), from a container such as an automobile radiator 55, comprising:

a body member (11 or 53) having a chamber (12 or 54) for receiving a portion of the cap;

means (24 and 25 or 31 and 56 or 52 and 56) engagable with a portion of the cap; and means (15 or 30 and 35 or 51) connected to the body member being manually actuatable for effecting or causing an unlocking, for example, downward transition of the radiator cap toward the radiator, and/or an unscrewing transition or displacement of the cap.

Accordingly, it is an object of the present invention to provide a novel tool/device to facilitate safe and easy removal of caps from containers, particularly radiator caps from radiators.

A further object of the present invention is to provide a radiator cap removal/unscrewing device having means for accommodating various sized caps.

A still further object of the present invention is to provide a tool for aiding in the removal of a radiator cap while safely venting steam and superheated fluid which may be extruded from the radiator with loosening of the radiator cap.

Another object of the present invention is to provide a tool to facilitate the safe removal of different shaped radiator caps.

BRIEF DESCRIPTION OF THE DRAWINGS

The accompanying drawings diagrammatically illustrate three embodiments of the present invention by way of example. Like numerals refer to like parts throughout.

FIG. 4 is a side view of a second embodiment of a radiator cap removing/unscrewing device according to the invention;

FIG. 5 is a bottom view of the radiator cap removing device shown in FIG. 4;

FIG. 6 is a front perspective view of the leaf spring shown in FIGS. 4, 5, 7, 8 and 9;

FIG. 7 is a side view of a third embodiment of a radiator cap removing device according to the invention;

FIGS. 8 and 9 are bottom views of the radiator cap removing device shown in FIG. 7 being mounted about different type radiator caps.

DESCRIPTION OF THE PREFERRED EMBODIMENTS

Figure 1:
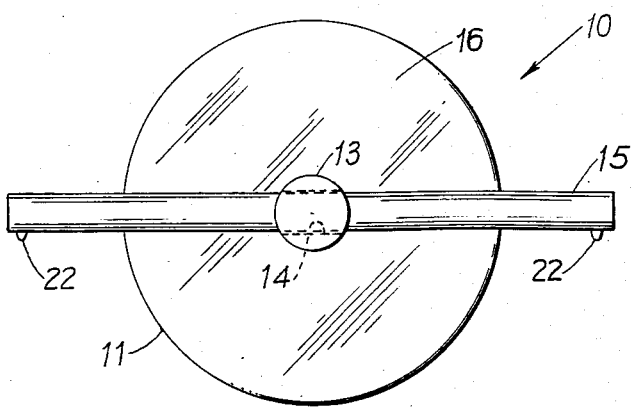
FIG. 1 is a top view of a first embodiment of a radiator cap removing device according to the invention.
Figure 3:
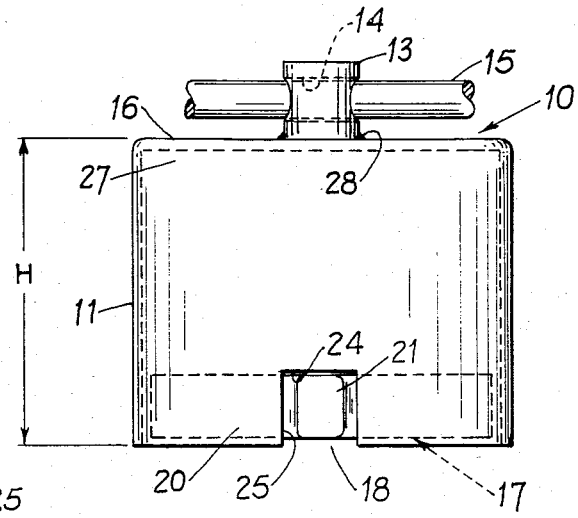
FIG. 3 is a side view of the radiator cap removing device shown in FIGS. 1 and 2.
Figure 2:
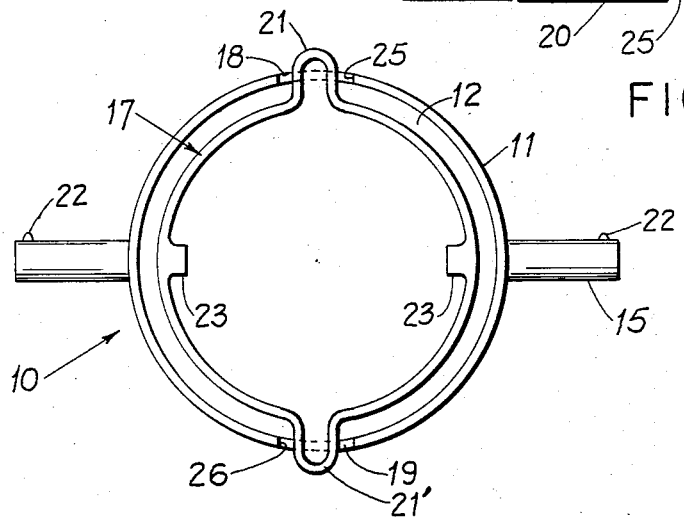
FIG. 2 is a bottom view of the radiator cap removing device shown in FIG. 1 mounted about a typical radiator cap.

As shown in FIGS. 1–3, the radiator cap removing device or tool 10 of the present invention includes a cylindrical body member or can 11 having an interior cavity or chamber 12, an upwardly projecting dome 13 having a transverse hole 14, and a lever arm 15 slidably mounted within hole 14. The top end of can 11 is closed by an upper wall 16 which supports dome 13 thereon. Dome 13 may be integrally formed with upper wall 16 or affixed thereto, for example, by welding 28. The bottom end of can 11 is open and extends into chamber 12. Chamber 12 is dimensioned for receiving a radiator cap 17. Body member 11 has a height H, for example, of approximately three inches, to enable an individual to grasp tool 10 for applying downward pressure on cap 17 as will be more fully described hereinafter. Two diametrically located slots 18 and 19 are provided at the circumferential bottom wall portion 20 of can 11. Each slot 18 and 19 is dimensioned for receiving a respective outwardly protecting tab or protuberant member 21 and 21' of cap 17. A projection 22 may be provided at each end of lever arm 15 for retaining lever arm 15 within hole 14 of dome 13.

The operation/function of tool 10 will now be described for being utilized in the removal or unscrewing of radiator cap 17 from an automotive radiator 55 (FIG. 7) which may contain superheated fluids and steam. It being understood that radiator cap 17 (shown in FIG. 2) is typically clockwise screwed unto the radiator such that one or more inwardly projecting tabs 23 engage a thread like flange which causes radiator cap 17 to cover the top neck 59 like orifice (not shown) of the radiator and thereby providing a watertight closure of the orifice. To secure radiator cap 17 in the closed disposition, the thread like flange typically includes notched portions (not shown) for receiving tabs 23. In order to unscrew the radiator cap 17, a downward pressure must be applied while counter-clockwise twisting radiator cap 17. Oftentimes, however, the boiling water and steam pressure within the (superheated) radiator causes an eruption following the unlocking and unscrewing of the radiator cap 12, which can cause injury to the individual removing the radiator cap.

In accordance with the present invention, tool 10 is placed over the closed radiator cap 17 such that tabs 21 and 21' each protrude from a respective slot 18 and 19. With radiator cap 17 within chamber 12, tool 10 is urged toward radiator 55, for example, by applying a downward force, such that the upper ledges 24 of each slot 18 and 19 abut a top portion of tabs 21 and 21' forcing radiator cap 17 downwardly. The downward transition of radiator cap 17 unlocks tabs 23 from the notched portions of the radiator's flanged neck 55. While maintaining a downward force, lever arm 15 may be manually actuated for rotating tool 10 counter-clockwise. The rotation of tool 10 causes wall portions 25 and 26 of slots 18 and 19, respectively, to engage a respective tab 21 and 21' thereby unscrewing radiator cap 17. By maintaining a suitable downward force on tool 10 and, thereby, radiator cap 17 while unscrewing same, any boiling water and steam being forced out of the now unsealed radiator is vented in a substantially more controlled manner prior to complete removal of radiator cap 17 from radiator 55.

The height H and material of tool 10 are selected to enable it to be manipulated for unscrewing the radiator cap 17. For example, body member 11 and top wall 16 are of heavy guage metal and of sufficient height H such that tool 10 does not become dangerously hot during the cap 17 unscrewing and radiator venting periods. Typically, the person wanting to unscrew the radiator cap 17 places tool 10 on/over cap 17 and, for example, grasps can 11 about an upper end portion 27 with his/her palm over or atop wall member 16 and dome 13. The person's other hand is then free to actuate lever arm 15, i.e., rotate counter-clockwise, to slowly unscrew cap 17 while, controllably venting the radiator at a relatively safe rate. Of course, quick or rapid unscrewing and/or removal of cap 17 should be avoided where the possibility of a violent and uncontrolled eruptive venting of the radiator may occur. Once the superheated radiator has been safely vented to relieve the eruptive pressure therewithin, cap 17 may be completely removed from the radiator. A heat resistant coating or outer jacket, for example, of wood or various resins such as those used to form some cookware handles, may be provided on or about the outer surface of tool 10 to further insulate and protect the tool user from excessively high temperatures which may otherwise be conductively transmitted through tool 10.

Referring now to FIGS. 4 and 5, an alternative embodiment of the invention is shown. The radiator cap removing/unscrewing device or tool 29 of this embodiment is similar to that shown in FIGS. 1–3, with the exception that a handle 30 is rotatably affixed atop dome 13, and that a cap clamping mechanism 31 is provided.

The handle 30 comprises an elongate, for example, wood member configured for being readily and securily held by a human hand. Handle 30 is rotatably mounted to dome 13 by means of a ball 32 and socket 33 arrangement. Socket 33 is formed within dome 13 and ball 32 is affixed to handle 30 by means of shaft 34 which is securily affixed to handle 30. A lever arm 35 is affixed to dome 13 to enable rotation of body member 53 relative to handle 30. In this manner, tool 29 may be grasped about heat resistant handle 30 while the body member is caused to rotate by actuation of lever arm 35. Lever arm 35 may be coated or jacketed with a heat resistant handle 36.

The cap clamping mechanism 31 generally comprises a leaf spring 37 and an adjustable deflector 38. The leaf spring 37 has a rectangular shape and is affixed in cantilever manner to body member 53 by conventional means such as rivet 39. Attached at the free/movable end 40 of leaf spring 37 is an outwardly projecting rod 41 having a plurality of (saw) teeth and a button like head portion 42. Rod 41 extends through a notch or keyway 43 formed in side wall 25. The teeth are configured with rod 41 being flexible to enable each tooth, e.g., tooth 44 to be selectively engaged on an inner ledge portion 45 of notch 43. In this manner, with manual actuation of head portion 42, the free end 40 of leaf spring 37 may be inwardly and outwardly disposed. As will be described in more detail with reference to FIGS. 8 and 9, the cap clamping mechanism 31 enables a single fixed diameter body member 53 tool 29 to be utilized to unscrew/remove various sized and shaped (radiator) caps 17, 47 and 65.

The leaf spring 37 is provided with gripping edges or a knurled surface 46 (see FIG. 6) to enhance friction and gripping of the side walls of the radiator cap 47. Likewise, a portion of the inner side walls 48 of body member 53 may be knurled to further improve the clamping about radiator cap 47 between leaf spring 37 and inner side walls 48.

Referring now to FIGS. 7, 8 and 9, another alternative embodiment of the invention is shown. The radiator cap removing/unscrewing device 50 of this embodiment is similar to that shown in FIGS. 4 and 5, with the exception that a door knob shaped handle 51 and screw like clamping mechanism 52 are provided. Tool 50 may be formed of heat resistant plastic or phenolic with an integrally formed handle 51. Alternatively, body member 53 and leaf spring 37 may be formed of suitable metal, with handle 51 being made of wood, phenolic or other heat resistant material. Handle 51 is affixed to dome 13 by any suitable conventional manner, for example, screws (not shown). Handle 51 is attached to body member 53 in this manner such that with rotation of handle 51 the body member 53 is caused to coincidentally rotate therewith.

The internal chamber 54 has a depth dimensioned for receiving a portion of radiator cap 47 or 65 such that a portion of its top wall 56 will abut with the inner wall portion 57 of top wall 58. In this manner, tool 50 may be used to provide downward pressure, i.e., in the direction of radiator 55 (partially cutaway) to unlock tabs 23 from notches (not shown) within neck portion 59 of radiator 55.

The clamping mechanism 52 basically comprises leaf spring 37, a threaded bolt 60 projecting outwardly from end 40 through notch 43 and a manually actuatable knob or nut like adjustment member 62. Knob 62 has a knurled rotatable head without the body member 53, a washer shaped inner member 53 within chamber 54 and an intermediate section 64 of reduced diameter. With intermediate section 64 disposed between the walls of notch 43, head 62 and washer 63 have portions extending beyond notch 43 to overlap respective outer and inner walls about notch 43. Bolt 60 is threadably received within and engages internal thread portions of knob 62. With clockwise and counter-clockwise rotation of knob 62, bolt 60 and, therefore, end 40 of leaf spring 37 may be inwardly and outwardly disposed.

The operation of tool 50 for removal or unscrewing of various type radiator caps 17,47 and 65 will now be described with particular reference to FIGS. 7, 8 and 9. It being understood that aside from the method of actuating the clamping mechanism 31 shown in FIGS. 4 and 5, the following discussion is equally applicable to tool 29.

Firstly, let us assume that radiator cap 17 is to be unscrewed from radiator 55. Radiator cap 17 is sized such that tabs 21 and 21' extend through notches 18 and 19 as shown in FIG. 2. Upper ledge 24 of each notch 18 and 19 of tool 50 (or 29) abuts a respective tab 21 and 21'. Handle 51 (or 30) is grasped and with application of downward pressure in the direction of radiator 55, cap 17 is urged downwardly unlocking tabs 23. Next, by rotating knob 51 (or handle 35) walls 25 and 26 of body member 53 engage a respective tab 21 and 21' causing rotation and, therefore, unscrewing of radiator cap 17. It being understood that to accommodate this large sized radiator cap 17 within chamber 54, the clamping mechanism 52 (or 31) is adjusted to dispose leaf spring 37 toward and in juxtaposition with inner side wall 67 of body member 53.

If we now assume that a radiator cap 65 which is of smaller diameter (see FIG. 8) is to be unscrewed, knob 62 (or deflector 38) is actuated until end 30 of leaf spring 37 is inwardly disposed by bolt 60 into alignment with a portion 68 of one of the tabs 21'. With the other tab 21 being within notch 18 and top wall 56 abutting wall 57 of body member 53, a downward and rotational (unscrewing) dispositioning of radiator cap 65 may be effected in similar manner as described above.

If we now assume that a round radiator cap 47 not having tabs 21 and 21' is to be unscrewed and removed from radiator 55 (see FIGS. 7 and 9), tool 50 is placed over cap 47 such that cap 47 is within chamber 54 interposed between the inner wall portion 48 of body member 53 and leaf spring 37. Knob 62 is then rotated causing bolt 60 to inwardly bend leaf spring 37 into engagement with cap 47. In this manner, cap 47 may be clamped or held between leaf spring 37 and the inner wall 48 of body member 53. With top wall 56 of cap 47 abutting wall 57, cap 47 may be disposed downwardly to unlock tabs 23 with downward pressure on handle 51. Since cap 47 is clamped within chamber 54 by means of clamping mechanism 52, rotation of handle 51 can be effected to cause unscrewing of cap 47. As noted above, clamping and frictional engagement of cap 47 is facilitated by gripping edges or knurled surfaces 46 and 48 on leaf spring 37 and body member 53, respectively.

Following a venting of the radiator 55 while cap 47 is partially unscrewed and/or fully unscrewed but held atop neck 59 by manually maintaining downward pressure on handle 51 (or 30), cap 47 may then be removed from radiator 55 with lifting of tool 50 which holds cap 47 within chamber 54 until knob 62 is rotated to loosen, i.e., outwardly dispose leaf spring 37, clamping mechanism 52.

While the invention has been described with respect to several preferred embodiments, it should be apparent to those skilled in the art that numerous modifications may be made thereto without departing from the spirit and scope of the invention. For example, the handle 30, leaf spring 37 and knob may be configured for being replaceable to enable repair or to enable additional features and functions of the cap removing device.

I claim:

1. A tool for unscrewing an automobile radiator cap from a radiator comprising:

a unitary body member having a cup shape and a bottom rim, said bottom rim having two diametrical notches, and having a chamber for receiving a portion of the radiator cap;

a handle means formed of substantially nonconductive thermal material affixed to said body member for enabling manual rotation of said body member;

clamping means mountable on said body member and being manually adjustable for clamping engagement with a portion of the radiator cap; and whereby the radiator cap being unscrewable from the radiator with rotation of said body member.

2. A tool as in claim 1, wherein:

the clamping means has a substantially flat rectangular shaped contact blade member being movably mounted within said chamber, said blade member being coupled to an adjustment means for enabling manual actuation of said blade member for causing engagement with the cap being clamped between said blade member and a portion of the body member within said chamber.

3. A tool as in claim 1, wherein:

the body member is elongate having a length of approximately three inches.

4. A tool as in claim 2, wherein:

the clamping means includes a nut and bolt mechanism, said nut having a portion without said body member and being rotatable for inwardly and outwardly moving said bolt, said bolt having a portion engagable with said blade member whereby said blade member is inwardly and outwardly movable for engaging and disengaging with the cap.

5. A tool as in claim 1, wherein:

the clamping means has a leaf spring member affixed at one end to said body member with its other end being inwardly and outwardly movable within said chamber, said movable end having a rod affixed at one end thereto with its other end cantilevered outwardly through a notch within said body member and having a head portion without said body member, said rod having a plurality of teeth means engagable with a ledge portion of said body member for disposing the movable end of said leaf spring at manually selectable positions within said chamber.

6. A tool as in claim 1, wherein:

the body member has a portion engagable with the cap whereby the cap may be urged downwardly with a manually applied downward force being applied to said handle means for effecting an unlocking disposition of the cap with the radiator.

7. A tool as in claim 1, wherein:

the body member is formed of a heat resistant material.

8. A tool as in claim 1, including:

a lever arm cantilevered mounted to a portion of said body member and having an outer covering formed of a substantially thermal nonconducting material.

9. A tool as in claim 8, wherein:

the handle means is rotatably mounted to said body member.

10. A tool as in claim 1, wherein:

the chamber is dimensioned for receiving the cap such that the bottom rim of said body member forms a skirt about and extending below the cap with said body member being placed over the cap.

11. A radiator cap removing device to facilitate removal of a radiator cap having two diametrically disposed projecting tabs from a vehicle radiator, comprising:

a unitary body member being cup shaped with a bottom rim, said bottom rim having two diametrical notches, and having a chamber for receiving the radiator cap;

a knob shaped handle means formed of a heat resistant material and being affixed to said body member to enable manual rotation of said body member with rotation of said handle means; and clamping means having a substantially flat rectangular shape contact blade member being movably mounted within said chamber, said blade member being engagable with a manual adjustment means for enabling actuation of said blade member for causing engagement with a portion of the radiator cap whereby the radiator cap being clamped between said blade member and a portion of the body member within said chamber.

* * * * *